US009738489B2

(12) United States Patent
Finschi

(10) Patent No.: US 9,738,489 B2
(45) Date of Patent: Aug. 22, 2017

(54) CONTROLLING AN ELEVATOR INSTALLATION USING A DISADVANTAGE PARAMETER OR A DISABILITY INDICATOR

(71) Applicant: Inventio AG, Hergiswil NW (CH)

(72) Inventor: Lukas Finschi, Ebikon (CH)

(73) Assignee: Inventio AG, Hergiswil NW (CH)

( * ) Notice: Subject to any disclaimer, the term of this patent is extended or adjusted under 35 U.S.C. 154(b) by 484 days.

(21) Appl. No.: 14/566,882

(22) Filed: Dec. 11, 2014

(65) Prior Publication Data

US 2015/0090534 A1 Apr. 2, 2015

Related U.S. Application Data

(63) Continuation of application No. 13/056,145, filed as application No. PCT/EP2009/059439 on Jul. 22, 2009, now Pat. No. 8,915,334.

(30) Foreign Application Priority Data

Jul. 31, 2008 (EP) ..... 08161591
Sep. 4, 2008 (EP) ..... 08163641

(51) Int. Cl.
*B66B 1/20* (2006.01)
*B66B 1/24* (2006.01)
*B66B 1/34* (2006.01)

(52) U.S. Cl.
CPC ..... *B66B 1/2466* (2013.01); *B66B 1/2408* (2013.01); *B66B 1/34* (2013.01);
(Continued)

(58) Field of Classification Search
CPC ..... B66B 1/34; B66B 1/2408; B66B 1/2466; B66B 1/3415; B66B 2201/103;
(Continued)

(56) References Cited

U.S. PATENT DOCUMENTS 4,993,518 A 2/1991 van Straaten et al.
5,719,360 A 2/1998 Davis
(Continued)

FOREIGN PATENT DOCUMENTS

CN 1037316 A 11/1989
EP 1193207 A1 4/2002
(Continued)

OTHER PUBLICATIONS

Janne Sorsa, (2006), Double-Deck Destination Control System, Elevcon, Helsinki 2006, the International Congress on Vertical TRansportation Technologies, pp. 1-13.
(Continued)

*Primary Examiner* — Anthony Salata
(74) *Attorney, Agent, or Firm* — Stroock & Stroock & Lavan LLP

(57) ABSTRACT

A method of controlling an elevator installation with several elevator cages per elevator shaft, wherein a destination call to a desired destination story is actuated on a call input story by at least one passenger and at least one most favorable call allocation for transport of the passenger by the elevator cage from a start story to a destination story, is determined for the destination call by at least one destination call control. If at least one disadvantage parameter is set, at least one disadvantage-free call allocation for transport of the passenger by the elevator cage from a start story to a destination story is determined by the destination call control, in which it is possible the start story and call input story or the destination story and desired destination correspond.

19 Claims, 4 Drawing Sheets

(52) U.S. Cl.
CPC ..... *B66B 1/3415* (2013.01); *B66B 2201/103* (2013.01); *B66B 2201/211* (2013.01); *B66B 2201/214* (2013.01); *B66B 2201/306* (2013.01); *B66B 2201/405* (2013.01); *Y10S 187/901* (2013.01)

(58) Field of Classification Search
CPC ..... B66B 2201/211; B66B 2201/214; B66B 2201/306; B66B 2201/405; Y10S 187/901; Y10S 187/902
USPC ..... 187/247, 249, 380–388, 391–393, 901, 187/902
See application file for complete search history.

(56) References Cited

U.S. PATENT DOCUMENTS

| | | | |
|---|---|---|---|
| 6,505,712 | B2 | 1/2003 | Hattori et al. |
| 6,508,333 | B2 | 1/2003 | Kostka et al. |
| 6,986,408 | B2 | 1/2006 | Takeuchi |
| 7,377,365 | B2 | 5/2008 | Abe et al. |
| 7,537,089 | B2 | 5/2009 | Duenser et al. |
| 7,581,622 | B2 | 9/2009 | Amano |
| 7,694,781 | B2 | 4/2010 | Sorsa et al. |
| 8,230,979 | B2 | 7/2012 | Finschi et al. |
| 8,387,756 | B2 | 3/2013 | Laihanen et al. |
| 8,413,766 | B2 | 4/2013 | Friedli |
| 8,915,334 | B2 * | 12/2014 | Finschi ..... B66B 1/2408 187/249 |
| 2002/0023804 | A1 | 2/2002 | Pfeffer |

FOREIGN PATENT DOCUMENTS

| | | | |
|---|---|---|---|
| EP | 2307300 | A1 | 4/2011 |
| JP | 09-235080 | A | 9/1997 |
| JP | 11-071063 | A | 3/1999 |
| JP | 2002-120976 | A | 4/2002 |
| JP | 2003-040535 | A | 2/2003 |
| JP | 2003252535 | A | 9/2003 |
| JP | 2003-341955 | A | 12/2003 |
| JP | 2004-131226 | A | 4/2004 |
| JP | 2005-289616 | A | 10/2005 |
| JP | 2008-063088 | A | 3/2008 |
| JP | 2011027527 | A | 2/2011 |
| WO | 01/72621 | A1 | 10/2001 |
| WO | 2006/000618 | A2 | 1/2006 |
| WO | 2007/130009 | A1 | 11/2007 |
| WO | 2007/147927 | A1 | 12/2007 |
| WO | 2008/040836 | A1 | 4/2008 |

OTHER PUBLICATIONS

Simon Russett, Make Mine A Double, Building Services Journal Aug. 2006, pp. 44-46.

James W. Fortune, Predestination Hall Call Selection for Double-Deck Lifts (3D Encoding), Elevator World, Aug. 2005, pp. 126, 128-133.

International Search Report for PCT/EP2009/059439 mailed Oct. 9, 2009.

* cited by examiner

CONTROLLING AN ELEVATOR INSTALLATION USING A DISADVANTAGE PARAMETER OR A DISABILITY INDICATOR

CROSS-REFERENCE TO RELATED APPLICATIONS

This application is a continuation of, and claims priority to, U.S. application Ser. No. 13/056,145, filed on May 20, 2011 and to be issued as U.S. Pat. No. 8,915,334 on Dec. 23, 2014, which claims priority to the National Stage of International Application No. PCT/EP2009/059439, filed on Jul. 22, 2009, which claims the benefit of European Patent Application No. 08163641.7, filed Sep. 4, 2008, and European Patent Application No. 08161591.6, filed Jul. 31, 2008. The contents of all of these applications are incorporated herein by reference.

FIELD

The disclosure relates to controlling an elevator installation, for example, an installation that can be used by handicapped passengers.

BACKGROUND

An elevator installation transports a passenger between stories of a building by an elevator cage. For that purpose the passenger inputs his or her call at destination call controls in advance. In the case of an elevator installation with several elevator cages, the destination call control assigns the destination call that elevator cage which serves the destination call as favorably as possible, i.e. with a shortest possible waiting time or shortest possible destination time. The waiting time is the time between call input and opening of a story door on arrival of the elevator cage at the start story. The destination time is the time between call input and opening of the story door on arrival of the elevator cage at the destination story.

EP1193207A1 discloses a method of controlling an elevator installation having a multiple cage. The multiple cage comprises several elevator cages. The elevator cages are so arranged that, when the multiple cage stops, passengers can simultaneously enter the elevator cages from several stories. Correspondingly, the multiple cage also serves several destination stories by one journey, but each with only one of the multiple cages. The passenger goes each time to the start story from where an elevator cage transports him or her as directly as possible to his or her destination story in many cases either the start story differs from its instantaneous location or from the story of the call input, or the destination story that the passenger is moved to differs from the desired destination story.

SUMMARY

In some embodiments of a method for controlling a elevator installation with several elevator cages per elevator shaft, a destination call to a desired destination story is actuated by at least one passenger on a call input story and at least one most favorable call allocation for transport of the passenger by the elevator cage from a start story to a destination story is determined for the destination call by at least one destination call control; if at least one disadvantage parameter is set, at least one disadvantage-free call allocation for transport of the passenger by the elevator cage from a start story to a destination story is determined by the destination call control, in which the start story is net the same as the call input story.

This can mean that a passenger with a disadvantage is transported free of disadvantage from a start story, which as far as possible is the same as the call input story, for the most part directly to the destination story. The passenger with disadvantage can thus more simply participate in business life, make social contacts, develop and continue education and exercise gainful employment.

In some cases, if no disadvantage parameter is set at least one most favorable call allocation for transport of the passenger by the elevator cage from a start story to a destination story is determined by the destination call control in which the start story is not necessarily the same as the call input story and/or the destination story is not necessarily the same as the desired destination story.

This can mean that passengers without disadvantage gain a most favorable call allocation in which the start story is not necessarily the same as the call input story and/or the destination story is not necessarily the same as the desired destination story. Since a greater choice of elevator cages is present, a more flexible call allocation can be undertaken. Particularly in large buildings and at peak times different building regions can thus be served at the same time from a main story by several elevator cages.

In some cases, a disadvantage of a passenger on at least one route to the elevator installation or during transport by the elevator installation or on at least one route to a travel destination is indicated by the disadvantage parameter.

This can mean that a disadvantage of the passenger on a route in the building as well as during transport in the elevator installation is eliminated. In that case the passenger with a handicap can move from an entrance of the building to a travel destination on a destination story and conversely from a room of the building to a travel destination at an exit of the building.

Sometimes, it is indicated by the disadvantage parameter that the passenger can move or orientate himself or herself in the building only with use of at least one handicap-specific aid. Possibly, a wheelchair or a patient bed on rollers or a crutch or a hearing aid or a seeing aid or a guide stick or a guide dog or an accompanying passenger is used as handicap-specific aid.

This can mean that the passenger with handicap can indicate which and what form of handicap-specific aid he or she uses for progress in the building.

In some cases, it is indicated by the disadvantage parameter that the passenger can move in the building only with the use of at least one aid specific to personal protection.

This can mean that it is also possible to guarantee the transport of a passenger worthy of protection, i.e. a passenger with potential safety risk can be guaranteed by the elevator cage in the building personal safety of the passenger against third-party attacks.

In some cases, a spatial protection zone or a temporal protection zone or a bodyguard is used as an aid specific to personal protection.

This can mean that the passenger worthy of protection is transported by the elevator cage passively, i.e. displaced in space or time from other passengers, or actively, i.e. in the company of a bodyguard. In that case, through a spatial protection zone or a temporal protection zone a number of further passengers is kept as small as possible.

In some cases, the disadvantage parameter is set by the passenger at at least one input apparatus of at least one call input device or at at least one input/output apparatus of at least one mobile apparatus.

This can mean that the passenger with disadvantage can input a disadvantage parameter with great flexibility not only at a stationary call input device of the elevator installation, but also at a mobile apparatus.

In some cases, the disadvantage parameter is set by actuation of at least one button or at least one touch screen.

This can mean that the passenger with disadvantage only has to touch a clearly marked button or only a clearly marked touch screen in order to set the disadvantage parameter.

In some cases, at least one identification code is input at at least one input apparatus of at least one call input device or at at least one input/output apparatus on at least one mobile apparatus. In further cases, at least one identification code is transmitted in at least one radio network by at least one mobile apparatus; the identification code is received by at least one call input device in the radio network. In additional cases at least one destination call stored in at least one computer readable data memory and disadvantage parameter stored in at least one computer readable data memory are assigned to the identification code and set.

This can mean that the passenger can even transmit simply only an identification code and thus actuate a destination call and set a disadvantage parameter. This can be carried out when going past a stationary call input device or directly to the destination call control from a distance.

In some cases, the disadvantage parameter is set only if a disadvantage authorization is attested to by at least one identification code.

This can mean that only a passenger with disadvantage authorization in accordance with identification code is transported by the elevator installation in the building.

In further cases, the disadvantage parameter, the destination cart an for a disadvantage authorization is or are stored in at least one passenger profile.

This can mean that the disadvantage parameter or the destination call or the disadvantage authorization is simple to manage in that the passenger profile is sat up or called up and changed or varied.

In additional cases, at least one parameter specific to elevator installation is taken into consideration in the determination of the disadvantage-free call allocation for the destination call. For example, transport to the desired destination story, transport from the call input story, transport without transfer, transport without an intermediate stop, transport by a large elevator cage, transport by a slow elevator cage, transport by a fast elevator cage, transport with at least one story door closing slowly and/or transport with at least one story door closing quickly is or are taken into consideration.

This can mean that several parameters specific to elevator inaction can be selectively adapted in order to determine a disadvantage-free call allocation.

In further cases, if a disadvantage parameter is set the passenger is transported to the desired destination story; if no disadvantage parameter is set, the passenger is transported either to the desired destination story or to an actual destination story which differs from the desired destination story by at least one story.

This can mean that a passenger with disadvantage is transported dire to the desired destination story, while a passenger without disadvantage must in certain circumstances cover one or more stories by a staircase or escalator in correspondence with the most favorable call allocation in order to go from the actual destination story, to which the elevator cage has transported him or her, to the desired destination story.

In some cases, if a disadvantage parameter is set the passenger is transported from the call input story; if no disadvantage parameter set, the passenger is transported either from the call input story or from a start story which differs from the call input story by at least one story.

This can mean that a passenger with a disadvantage is transported directly from the call input story, whilst a passenger without a disadvantage must in certain circumstances cover one or more stories by a staircase or an escalator in correspondence with the most favorable cast allocation in order to be transported by the elevator cage from the start story.

In some cases, if a disadvantage parameter is set the passenger is transported by one and the same elevator cage without transfer; if no disadvantage parameter is set, the passenger is transported either by one and the same elevator cage without transfer or with at least one transfer between elevator cages.

This can mean that the passenger with disadvantage is transported without transfer, whilst a passenger without disadvantage in certain circumstances has to transfer once or several times in correspondence with the most favorable call allocation.

In further cases, if a disadvantage parameter is set the passenger is transported by the elevator cage without an intermediate stop; if no disadvantage parameter is set, the passenger is transported either by the elevator cage without an intermediate stop or by the elevator cage with at least one intermediate stop.

This can mean that a passenger with a disadvantage is transported without an intermediate stop, whilst the elevator cage of the passenger without a disadvantage in certain circumstances fits in one or more intermediate stops in correspondence with the most favorable call allocation.

In further cases, if a disadvantage parameter is set a passenger with handicap-specific aid is transported by a slower elevator cage or a passenger with an aid specific to personal protection is transported by a fastest possible elevator cage. In particular cases, if a disadvantage parameter is set a passenger with handicap-specific aid is transported by an elevator installation with at least one slowly closing story door, or a passenger with aids specific to persona protection is transported by elevator installation with at least one quickly closing story door.

This can mean that for passengers with a disadvantage distinction is made between different disadvantages, and that parameters specific to elevator installation and in part contradictory are selectively taken into consideration.

In some cases, at least one situation-specific parameter is taken into consideration in the determination of the disadvantage-free call allocation for the destination call. In further cases, a smallest possible elevator cage passenger number or a smallest possible travel/passenger number or a shortest possible travel distance is taken into consideration as situation-specific parameter.

This can mean that a situation-specific parameter adaptable in order to determine a disadvantage-free call allocation.

In further cases, at least one building parameter is taken into consideration in the determination of the disadvantage-free call allocation for the destination call. In some cases, a shortest possible travel time, a shortest possible travel route, a flattest possible route, a widest possible route, a safest possible route and/or an accompanied route to the destination story is or are taken into consideration as building parameter.

This can mean that several building parameters are selectively adaptable in order to determine a disadvantage-free call allocation.

In further cases, if a disadvantage parameter is set the elevator cage is gone to by passenger from the call input story on a flat route or the elevator cage is left by the passenger on a flat route to the desired destination story.

This can mean that the passenger with a disadvantage can go to or leave the elevator cage on a flat route.

In some cases, a multiple cage is used as elevator cage, which is entered by the passenger without use of a staircase or an escalator from the call input story or which is left by the passenger without use of a staircase or an escalator to the desired destination story.

This can mean that the passenger with a disadvantage does not have to use a staircase or an escalator in going to or leaving a multiple cage.

In some cases, at least one parameter specific to the elevator installation is taken into consideration in the determination of the most favorable call allocation for the destination call. In some cases, transport to the desired destination story, transport from the call input story, transport without transfer, transport without an intermediate stop, transport by a large elevator cage, transport by a slow elevator cage, transport by a fast elevator cage, transport with at least one slowly closing story door and/or transport with at least one quickly closing story door is or are taken into consideration as parameter specific to elevator installation.

This can mean that several parameters specific to the elevator installation are selectively adapt in order to determine a most favorable call allocation.

In some cases, at least one situation-specific parameter is taken into consideration in the determination of the most favorable call allocation for the destination call. In further cases, there is denoted by the most favorable call allocation that elevator cage which serves the destination call from a start story to a destination story in shortest possible waiting time or in shortest possible destination time.

This can mean that a most favorable call allocation is determined which serves the destination call quickly, wherein for attainment of a shortest possible waiting time or a shortest possible destination time there is selective adaptation not only of parameters specific to an elevator installation, but also situation-specific parameters.

In further cages, at least one destination call acknowledgement signal is communicated by the destination cab control to at least one address of the call input device to which the identification code was transmitted or at least one destination call acknowledgement signal is transmitted to the address of the mobile apparatus from which the identification code was transmitted. In some cases, at least one most favorable call allocation or at least one disadvantage-free call allocation is issued as at least one destination call acknowledgement signal on at least one output apparatus of the call input device or on at least one input/output apparatus of the mobile apparatus.

This can mean that the passenger on setting a disadvantage parameter receives a feedback from the destination call control.

In some cases, at least one item of multimedia information is issued for the most favorable call allocation or for the disadvantage-free call allocation. In further cases, at least one parameter specific to elevator installation or at least one situation-specific parameter or at least one building parameter is issued as item of multimedia information.

This can mean that the passenger receives a textual of graphic or acoustic item of route and travel information.

In some cases, a most favorable call allocation or a disadvantage-free call allocation is confirmed on at least one input apparatus of the call input device or an the input/output apparatus of the mobile apparatus.

This can mean that the passenger enters into communication with the destination call control and actively confirms the determined most favorable call allocation or disadvantage-free call allocation.

In some cases, several most favorable call allocations or several disadvantage-free call allocations are issued as destination all acknowledgement signals; one of these most favorable call allocations or disadvantage-free call allocations is selected by confirmation.

This can mean that the passenger can select which most favorable call allocation or which disadvantage-free call allocation he or she desires. The passenger can thus either select a most favorable call allocation in which he or she is transported in a rapid journey with shortest possible waiting time, where he or she perhaps has to cover a story on foot in a staircase, or, however, he or she accepts a longer waiting time and is as a consequence also moved by an empty and sale elevator cage directly to the destination story desired by him or her. The passenger with disadvantage can thus either select a disadvantage-free call allocation in which he is transported by en elevator cage directly to the destination story or he or she selects a largest possible elevator cage so that he or she has a large amount of space during transport to the destination story for his or her wheelchair.

In some cases, a disadvantage-free call allocation is determined for a set disadvantage parameter only if at least one control parameter is activated by the destination call control. In further cases, the control parameter is deactivated by the destination call control if at least one current traffic level of the elevator installation exceeds at least one predefined target value or if a current clock time lies in at least one predefined time window or if the desired destination stony lies in at least one predefined building zone.

This can mean that the determination of a disadvantage-free call allocation can be simply and quickly deactivated in the case of a large level of traffic or at peak times or for a desired destination story in a specific building zone.

In some cases, a control parameter deactivated for a destination call is reactivated by at least one disadvantage authorization of the passenger actuating a destination call.

This can mean that a passenger can assert his or her disadvantage relative to the destination call control.

In some cases, a computer program product comprises at least one computer program means suitable for realizing the method for control of a elevator installation and that at least one method step is performed when the computer program means is loaded into the processor of a destination call control or of a call input device or of a mobile apparatus. In further cases, the computer readable data memory comprises such a computer program product.

DESCRIPTION OF THE DRAWINGS

The disclosure is explained in detail by way of the figures, for which purpose.

DETAILED DESCRIPTION

Figure 1:
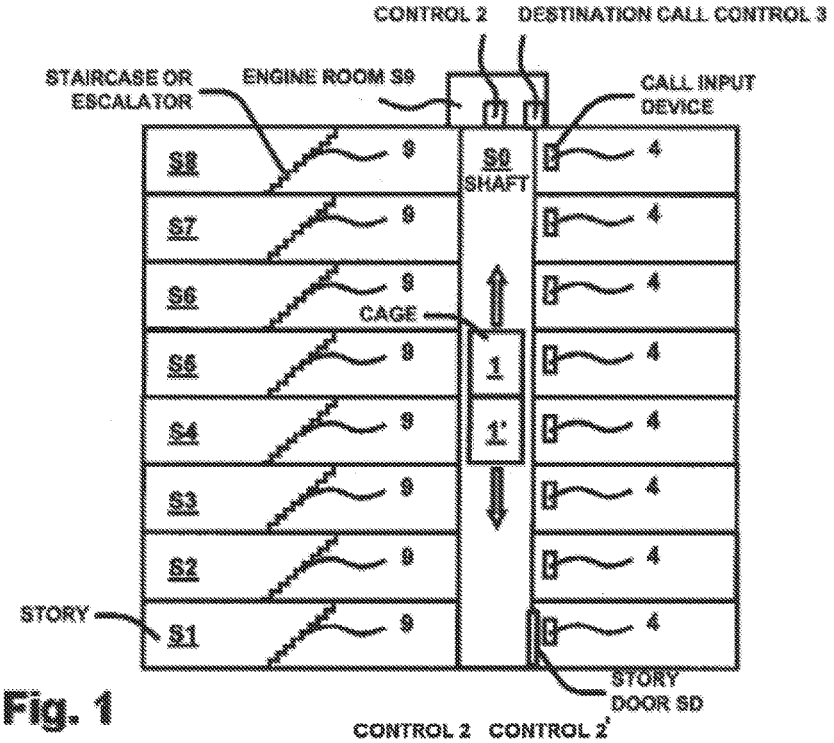
FIG. 1 shows a schematic view of a part of a first exemplifying embodiment of an elevator installation with a multiple cage.
Figure 2:
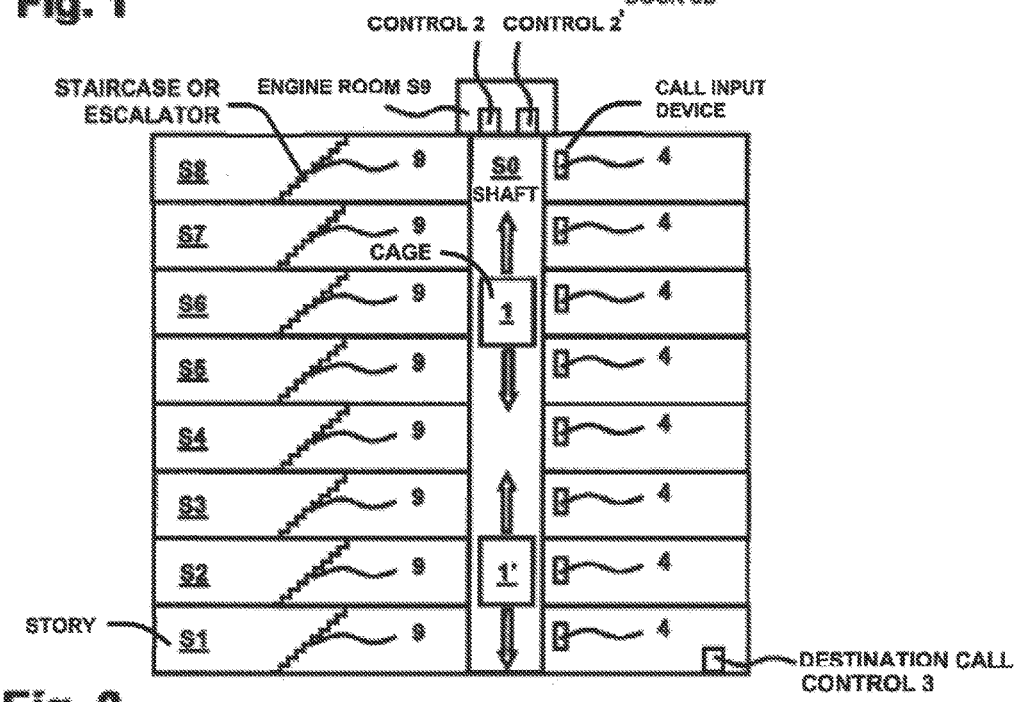
FIG. 2 shows a schematic view of a part of a second exemplifying embodiment of an elevator installation with several elevator cages per elevator shaft.
Figure 3:
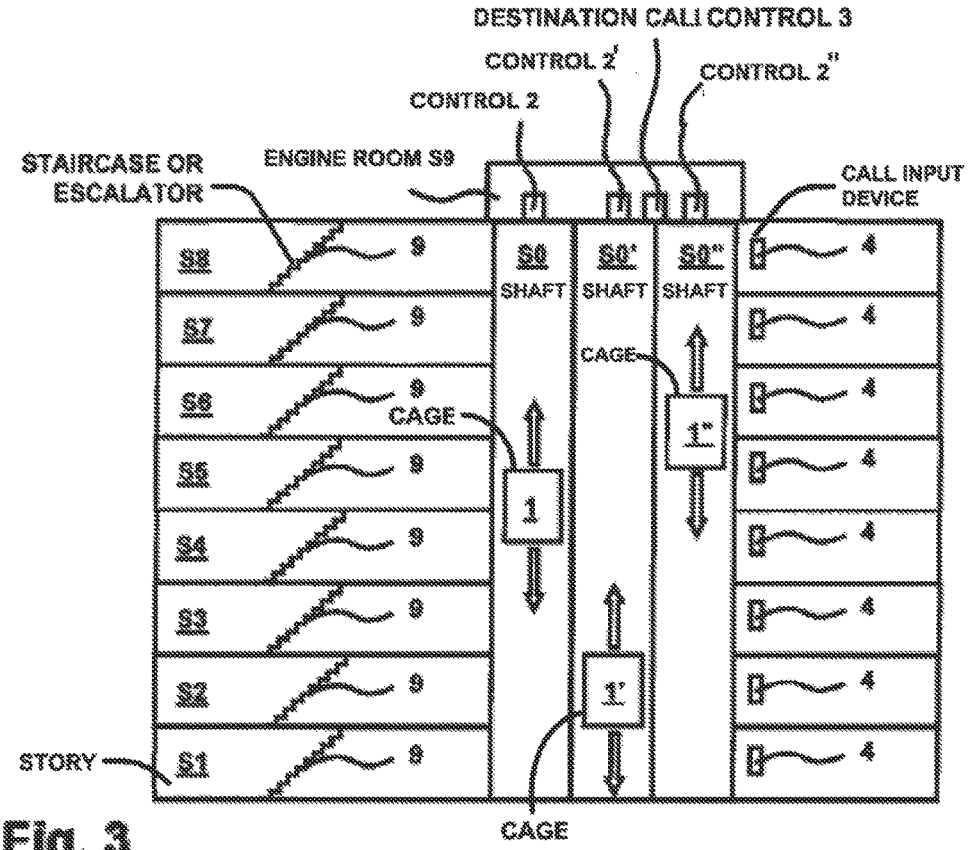
FIG. 3 shows a schematic view of a part of a third exemplifying embodiment of an elevator installation with several elevator cages in several elevator shafts.

FIGS. 1 to 3 show three exemplifying embodiments of an elevator installation with several elevator cages 1, 1', 1" in a building. The building has a greater number of stories S1 to S8. According to FIGS. 1 to 3 the elevator cages 1, 1', 1" serve eight stories S1 to S8 of the building. A passenger can enter and leave an elevator cage 1, 1', 1" on each of the stories S1 to S8 by way of at least one story door SD. The building also has at least one staircase or escalator 9. According to FIG. 1 each story S1 to S8 is reachable by way of a staircase or an escalator 9. At least one control 2, 2', 2" is arranged in at least one engine room S9. Each control 2, 2', 2" controls at least one elevator drive and at least one door drive of the elevator installation and thus moves at least one elevator cage 1, 1', 1" and opens and closes at least one story door. According to FIG. 1 the elevator installation has, in an elevator shaft S0, a multiple cage with two elevator cages 1, 1' arranged in one frame. An elevator drive of this multiple cage is controlled by a control 2 and thus moves the elevator cages 1, 1' arranged in the frame. According to FIG. 2 the elevator installation has two elevator cages 1, 1' arranged one above the other in a elevator shaft S0. Two elevator drives of the two elevator cages 1, 1' are controlled by two controls 2, 2'. Each control 2, 2' moves an elevator cage 1, 1' independently of the other control 2, 2'. According to FIG. 3 the elevator installation has three elevator cages 1, 1', 1", wherein each elevator cage 1, 1', 1" is arranged in an own elevator shaft S0, S0', S0". Three elevator drives of the three elevator cages 1, 1', 1" are controlled by three controls 2, 2', 2". Each control 2, 2', 2" moves an elevator cage 1, 1', 1" independently of the other controls 2, 2', 2". Each control 2, 2', 2" obtains items of information about the instantaneous position of the elevator cage 1, 1', 1" in the elevator shaft S0, S0', S0" from at least one shaft information means. Each control 2, 2', 2" has at least one signal bus adapter 28, 28', 28" for at least one signal bus 8, 8', 8". Each participant in the communication in the signal bus 8, 8', 8" has a unique address. The signal bus 8, 8', 8" is, for example, an LON bus with LON protocol, an Ethernet network with the Transmission Control Protocol/Internet Protocol (TCP/IP), an Attached Resources Computer Network (ARCNET), etc.

The story door, elevator drive, door drive, shaft information means and further components of a elevator installation such as a counterweight, a drive and support means, etc., are not individually illustrated for reasons of clarity of the illustration in FIGS. 1 to 3. With knowledge of the present disclosure the expert can realize a elevator installation with less or with substantially more elevators, such as a group with six or eight elevators; with triple cages; with more than two elevator cages, which are arranged one above the other and movable independently of one another, per elevator shaft; with elevators without counterweights, with hydraulic elevators; etc. In addition, the story door usually consists of two components, namely a building door which opens and closes the elevator shaft relative to the building and a cage door which opens and closes the elevator cage relative to the elevator shaft. A passenger gains access from a story to the elevator cage only when both the building door and the cage door are opened by the door drive.

Figure 4:
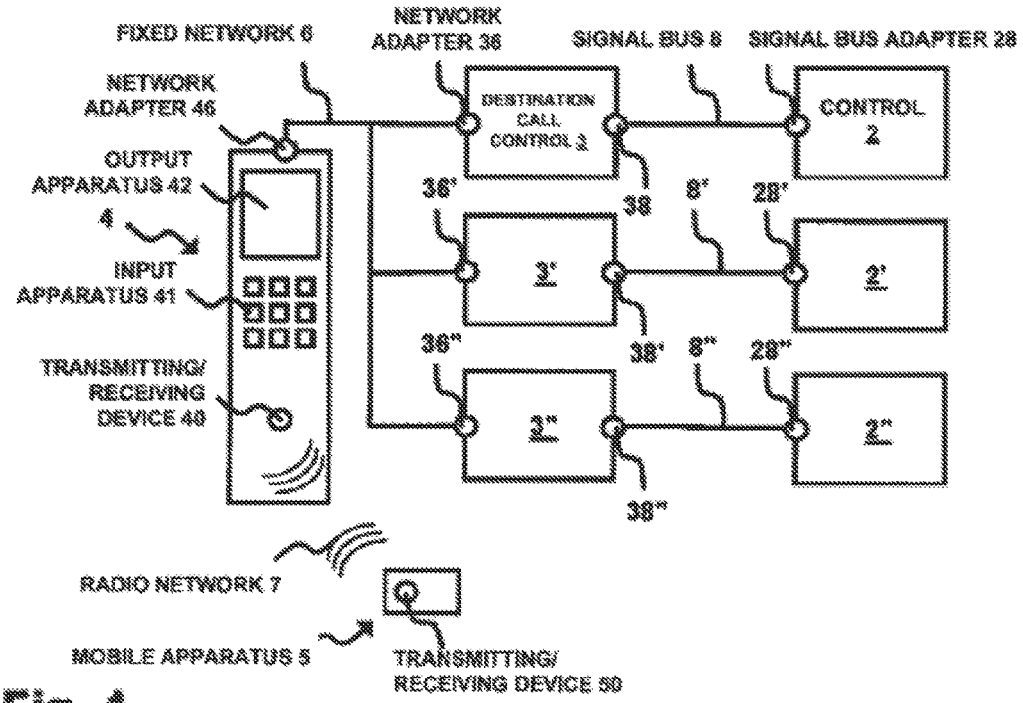
FIG. 4 shows a schematic view of a part of a first exemplifying embodiment of a call input in the elevator installation according to FIGS. 1 to 3.
Figure 5:
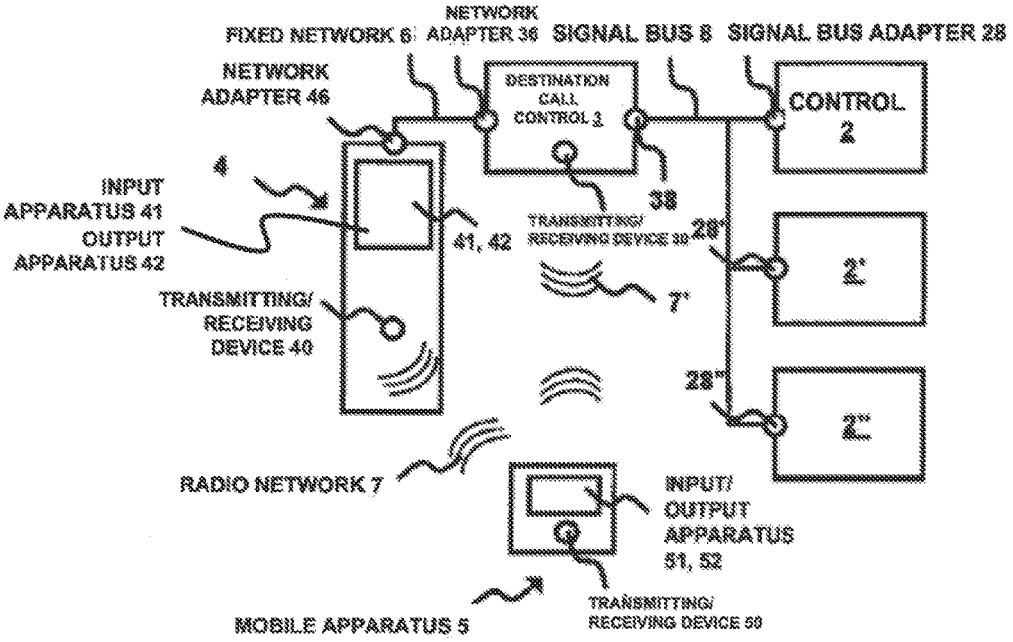
FIG. 5 shows a schematic view of a part of a second exemplifying embodiment of a call input in the elevator installation according to FIGS. 1 to 3.

FIGS. 4 and 5 show two exemplifying embodiments of a call input device 4 for input of at least one destination call. At least one call input device 4 is arranged in stationary position on each story S1 to S8 near a story door. The call input device 4 can be mounted on a building wall or stand in isolation in a space in front of the story door. At least one transmitting/receiving device 40 for at least one radio network 7, 7', at least one network adapter 46 for at least one network 6, at least one output apparatus 42 and at least one electrical power supply means are arranged in a housing of the call input device 4. In addition, at least one input apparatus 41 can be arranged in the housing of the call input device 4. The call input device 4 comprises at least one processor and at least one computer readable data memory. At least one computer program means is loaded from the computer readable data memory into the processor and executed. The computer program means controls the transmitting/receiving device 40, the network adapter 46, the input apparatus 41 and the output apparatus 42.

According to FIG. 4 the call input device 4 as input apparatus 41 comprises buttons by which the passenger can manually input a destination call by way of at least one numerical sequence. According to FIG. 5 the call input device 4 is button-free and provision of a destination call is carried out contactlessly by reading at least one identification code out of at least one computer readable data memory of at least one mobile apparatus 5, which is carried by the passenger, by the transmitting/receiving device 40. At least one destination call acknowledgement signal is issued on the output apparatus 42 to the passenger. The passenger thus obtains on the output apparatus 42 an optical or acoustic destination call acknowledgement. The call input by way of buttons and the contactless call input can be combined with one another. The passenger can change or cancel the destination call, which is provided by reading out from the computer readable data memory, on the input apparatus 41 of the call input device 4. For example, a destination call is stored as a predefined destination call in at least one passenger profile. The passenger profile is uniquely associated with the passenger, i.e. each passenger has an own individual passenger profile. According to FIG. 5 the input apparatus 41 is a touch screen, which touch screen is at the same time also the output apparatus 42.

At least one destination call control 3, 3', 3" comprises at least one processor, at least one computer readable data memory, at least one network adapter 36 for the fixed network 6, or at least one transmitting/receiving device 30 for the radio network 7, 7', at least one signal bus adapter 38, 38', 38" for the signal bus 8, 8', 8" and at least one electrical power supply means. The call input device 4 communicates, in the fixed network 6, an input destination call or the read-out identification code to the destination call control 3, 3', 3". The destination call control 3, 3', 3" assigns at least one destination call to the identification code or determines at least one most favorable call allocation for a destination call. According to FIG. 1 the destination call control 3, 3', 3" is an independent electronic unit in an own housing, which, for example, is positioned in the story S1. The destination call control 3, 3', 3" can also be an electronic insert module in the form of, for example, a circuitboard, which circuitboard according to FIG. 4 is pushed into a housing of a control 2, 2', 2" or according to FIG. 5 pushed into a housing of a call input device 4. If the elevator installation has several destination call controls 3, 3', 3", for example according to FIG. 2 a destination call control 3, 3', 3" is associated with each control 2, 2', 2", then the destination call controls 3, 3', 3" communicate with one another by way of the fixed network 6. The passenger profile with the predefined destination call can be stored in the computer readable data memory of the destination call control 3, 3', 3" or in the computer readable data memory of the mobile apparatus 5.

The most favorable call allocation denotes a journey by at least one elevator cage 1, 1', 1" from a start story to a destination story. The start story does not have to correspond with the call input stony. In addition, the destination story does not have to correspond with the destination story desired by the passenger in accordance with the destination call. On assignment of the most favorable call allocation to the elevator cage 1, 1', 1" at least one start call signal and at least one destination call signal are produced and communicated by way of the signal bus 8, 8', 8" to the signal bus adapter 28, 28', 28" of the control 2, 2', 2", of this elevator cage 1, 1', 1". At least one computer program means is loaded from the computer readable date memory of the destination call control 3, 3', 3" into the processor of the destination call control 3, 3', 3" and executed. The computer program means also runs through the most favorable call allocation and the computer program means also runs through generation of the start call signal and the destination call signal. The computer program means also controls the communication with the control 2, 2', 2" by way of the signal bus 8, 8', 8" and the communication with the call input device 4 by way of the fixed network 6. The computer program means of the destination call control 3, 3', 3" can also be loaded into a processor of a call input device 4 or of a control 2, 2', 2" and executed there. The computer readable data memory of the destination call control 3, 3', 3" can also be a computer readable data memory of a call input device 4 or of a control 2, 2', 2".

The mobile apparatus 5 is carried by the passenger and is a Frequency Identification Device (RFID) and/or a mobile telephone and/or a computer with at least one transmitting/receiving device 50. According to FIGS. 5 and 6 at least one input/output apparatus 51, 52 is additionally arranged in the mobile apparatus 5. The input/output apparatus 51, 52 is a touch screen. At least one destination call acknowledgement signal is issued to the passenger on the input/output apparatus 51, 52. The passenger thus obtains on the input/output apparatus 52 an optical or acoustic destination call acknowledgement. The mobile apparatus 5 comprises at least one processor, at least one computer readable data memory and at least one electrical power supply. At least one computer program means is loaded from the computer readable data memory into the processor and executed. The computer program means controls the transmission and reception of the transmitting/receiving device 50 as well as the input or output by way of the input/output apparatus 51, 52.

The call input device 4 or the mobile apparatus 5 or the destination call control 3, 3', 3" communicate with one another by fixed network 6 or by radio network 7, 7'. In the case of RFID the range of the radio network 7, 7' is restricted to a few centimeters up to a few meters. However, a local radio network 7, 7' with a range of several tens of meters up to several tens of kilometers, such as Bluetooth according to the Standard IEEE 802.15.1, ZigBee according to the Standard IEEE 802.15.4, Wireless Local Area Network (WLAN) according to the Standard IEEE 802.11 or Worldwide Interoperability for Microwave Access (WIMAX) according to the Standard IEEE 802.16, can also be used. The radio frequency used by the radio network 7, 7' lies at, in the case of an RFID, 125 kHz, 13.56 MHz, 2.45 GHz, etc., in the case of a WLAN or ZigBee it lies in, for example, the 2.4 GHz band or in the 5.0 GHz band and in the case of WIMAX in the 10 to 66 GHz band. Known mobile telephone radio networks such as Global System for Mobile Communication (GSM) with frequencies of 900 to 1900 MHz can also be used as radio network 7, 7'. Not only the fixed network 6, but also the radio network 7, 7' permit a bidirectional communication according to known and proven network protocols such as the Transmission Control Protocol/Internet Protocol (TCP/IP) or Internet Packet Exchange (IPX). In that case each participant communicates data together with a unique address of the participant to a unique address of an addressee. The fixed network 6 comprises several electrical or optical data cables, which are laid buried in a building.

According to FIG. 5 the mobile apparatus 5 is an RFID with a transmitting/receiving device 50 in the form of a coil. The coil takes up inductive energy from the electromagnetic field of the radio network 7 of the transmitting/receiving device 40 of the call input device 4 and is thus activated in terms of energy. The activation in terms of energy takes place automatically as soon as the RFID is located in the range of the radio network 7. As soon as the RFID is activated in terms of energy, the processor reads out an identification code which is filed in the computer readable data memory and which is transmitted by way of the coil to the transmitting/receiving device 40 of the input device 4. The activation of the RFID in terms of energy and the transmission of the identification code to the call input device 4 take place contactlessly. The call input device 4 communicates the identification code to the destination call control 3, 3', 3" by way of the fixed network 6. The destination call control 3, 3', 3" communicates at least one destination call acknowledgement signal to the call input device 4.

According to FIG. 5 the mobile apparatus 5 communicates with the call input device 4 in a first radio network 7, the mobile apparatus 5 communicates with the destination call control 3, 3', 3" in a second radio network 7' and the call input device 4 and the destination call control 3, 3', 3" communicate with one another in the fixed network 6. As soon as the mobile apparatus 5 is located in the range of the first radio network 7 the mobile apparatus 5 communicates an identification code, which is filed in the computer readable data memory, or a destination call, which is input by way of the input/output apparatus 51, 52, to the call input device 4 in the first radio network 7. The call input device 4 communicates the identification code or the destination code to the destination call control 3, 3', 3" in the fixed network 6. The destination call control 3, 3', 3" communicates at least one destination call acknowledgement signal either in the fixed network 6 to the call input device 4 or in the second radio network 7' to the mobile apparatus 5.

Figure 6:
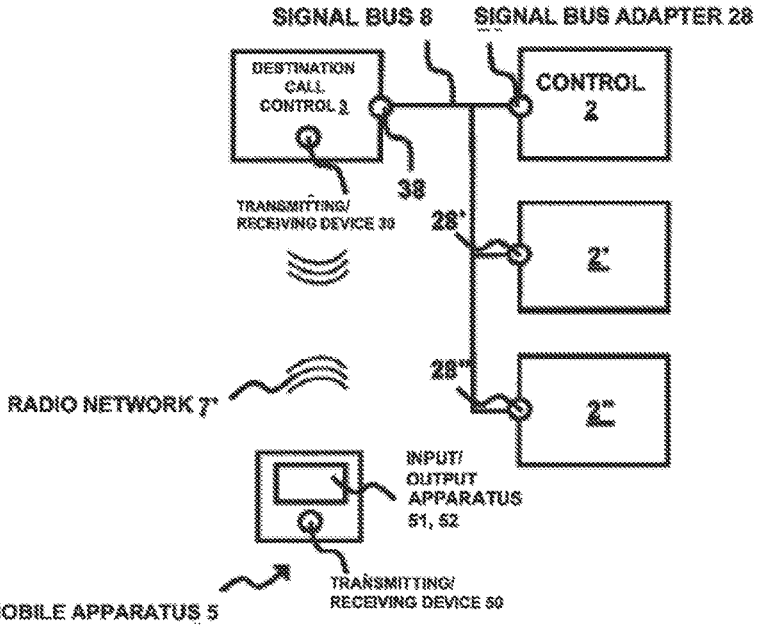
FIG. 6 shows a schematic view of a part of a third exemplifying embodiment of a call input in the elevator installation according to FIGS. 1 to 3.

In a third exemplifying embodiment of the call input of destination calls according to FIG. 6 an independent call input device 4 is not needed, since the mobile apparatus 5 communicates by way of the transmitting receiving device 50 in the radio network 7 directly with at least one transmitting/receiving device 30 integrated in the destination call control 3, 3', 3". As soon as the mobile apparatus 5 is in the range of the radio network 7, the passenger can communicate an identification code or destination call to the destination call control 3, 3', 3" and obtain communication from the destination call control 3, 3', 3" of a destination call acknowledgement signal. For example, at least one transmitting/receiving device 30 of the destination call control 3, 3', 3" is arranged on each story S1 to S8 so that a call input story is associated with the story S1 to S8 of the transmitting/receiving device 30 communicating with the mobile apparatus 5. Alternatively or additionally thereto the mobile apparatus 5 can communicate, together with the identification code or destination call, at least one position co-ordinate with which a call input story or a position on a call input story is associated. The position co-ordinate can be detected by at least one sensor of the mobile apparatus 5 such as a known Global Positioning System (GPS) or a barometric altimeter with accuracy of around one meter.

Figure 7:
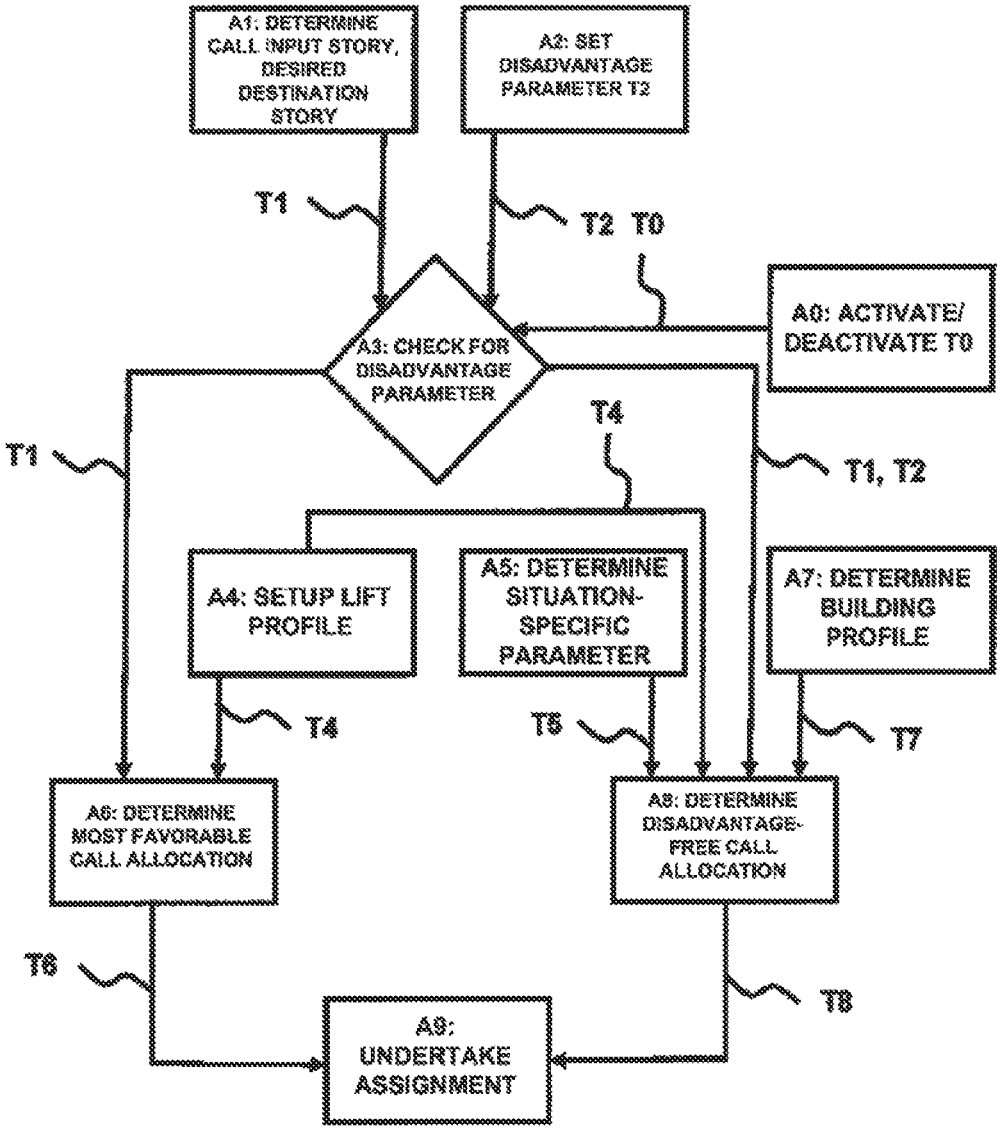
FIG. 7 shows a flow chart of a part of the method of controlling an elevator installation according to FIGS. 1 to 3.

The destination call control 3, 3', 3" operates with at least one optimization process for determination of a call allocation for a destination call. FIG. 7 shows a flow chart of the method for control of an elevator installation according to FIGS. 1 to 3.

In a first step A1 a call input story and a desired destination story are determined for a destination call T1. The call input story is the story S1 to S6 on which the call input device 4 is arranged in the building or the story S1 to S8 from which the mobile apparatus 5 communicates with the destination call control 3, 3', 3". The desired destination story is the destination story desired by the passenger.

In a second step A2 at least one disadvantage parameter T2 is set. The disadvantage parameter T2 indicates the degree of a disadvantage of the passenger for whom the destination call shall be executed. In that case the passenger is disadvantaged on the way to the elevator cage or during transport by the elevator cage or on the way from the elevator cage 1, 1', 1" to the travel destination. The disadvantage can be a handicap of the passenger or a potential risk to the safety of the passenger. In the simplest case the disadvantage parameter T2 indicates in binary manner whether or not the passenger is handicapped or whether or not the passenger safety is at risk. However, it is also possible to indicate in detailed form by the disadvantage parameter T2 the kind of handicap, such as handicap with respect to walking, handicap with respect to sight, handicap with respect to hearing, etc. It is also possible to indicate by the disadvantage parameter T2 whether the passenger with handicap needs passive personal protection or active personal protection. Thus, the disadvantage parameter T2 can distinguish between a strong or weak handicap as well as between a strong or weak risk of safety of the passenger as follows:

The disadvantage parameter T2 can indicate a strong disadvantage such as a handicap in access to/departure from the building or in transport by the elevator cage 1, 1', 1". The strong handicap can be a physical handicap or an intellectual handicap. Thus, the passenger can move or orientate himself or herself in the building only with the use of least one handicap-specific aid. A handicap-specific aid is, for example, a wheelchair, a patient bed on rollers, a crutch, a hearing aid, a strong seeing aid, a guide stick, a guide dog, etc. In addition, it can be the case that a strongly handicapped passenger can progress only with the help of at least one accompanying passenger. For example, an accompanying passenger pushes the wheelchair of the strongly handicapped passenger and actuates a call input for the strongly handicapped passenger.

The disadvantage parameter T2 can indicate a weak handicap such as lack of knowledge of the local conditions of the building or an inability to manage the at least one language used in the building. The building is, for example, a public building such as an administration centre, a hospital, etc., with a large number or stories S1 to S8 and a multiplicity of corridors. If the passenger is a visitor who finds himself or herself in the budding for the first time then it is very probable that he or she is poorly placed with regard to progress, in particular that this visitor has to proceed in the corridors in search of the elevator installation and needs substantially more time for travel to the elevator installation than a passenger who is very well familiarized with the local conditions in the building. For example, the passenger is a visitor who does not know the language used in the building and therefore cannot understand the data necessary for orientation in the building.

The disadvantage parameter T2 can indicate a strong disadvantage such as an acute risk to safety on a route of the building or in transport by the elevator cage 1, 1', 1". Thus, the passenger can move in the building only with use of at least one aid specific to personal protection. An aid specific to personal protection is, for example, a spatial protection zone or a temporal protection zone or a bodyguard. For example, a spatial protection zone or a temporal protection zone with as few further passengers as possible on the route to the elevator installation, in the elevator cage 1, 1', 1" or on the route to the travel destination is produced for the passenger. That can be carried out in that a route with a particularly low use frequency is selected for the passenger with disadvantage or in that an elevator cage 1, 1', 1" with as few further passengers as possible is provided. For that purpose further passengers can be conducted at earlier or later points in time on the route or in the elevator cage 1, 1', 1". In addition or alternatively thereto further passengers can be diverted onto another route or onto another elevator cage 1, 1', 1". It can also be the case that a passenger with acute safety risk is accompanied by at least one bodyguard on the route to the elevator installation, in the elevator cage 1, 1', 1" or on the route to the travel destination.

The disadvantage parameters T2 can indicate a weak disadvantage such as a risk to safety during access to/departure from the building or during transport by the elevator cage 1, 1', 1". For example, only a spatial protection zone or a temporal protection zone with as few further passengers as possible on the route to the elevator installation, in the elevator cage 1, 1', 1" or on the route to the travel destination is produced for the passenger with weak disadvantage.

The setting of the disadvantage parameter T2 can be carried out manually by the passenger at the input apparatus 41 of the call input device 4 or at the input/output apparatus 51, 52 of the mobile apparatus. In that case it is possible to provide different buttons or different regions of a touch screen for different disadvantages. For example, it is indicated by way of a first button or a first region of a touch screen that a passenger with a disadvantage can move or orientate himself or herself in the building only with use of at least one handicap-specific aid. For example, it is indicated by way of a further button or a further region of a touch screen that a passenger with disadvantage can move in the building only with use of at least one aid specific to personal protection. The disadvantage parameter T2 can, however, also be filed in the passenger profile, which passenger profile is stored in the computer-readable data memory of the destination call control 3, 3', 3" or in that of the mobile apparatus 5. For example, the disadvantage parameter T2 is read out at the time of call input of a destination call and communicated together with the destination call by the call input device 4 or by the mobile apparatus 5 to the destination call control 3, 3', 3" and set. It is particularly advantageous to store the passenger profile in the computer readable data memory of the destination call control 3, 3', 3" and to read it out and set it at the time of association of an identification code with a destination call in addition, different disadvantages such as use of at least one handicap-specific aid or use of at least one aid specific to personal protection can be indicated in the passenger profile. In addition, at least one disadvantage authorization can be stored in the passenger profile. A disadvantage authorization evidences that a passenger identified by an identification code is actually authorized for a disadvantage-free call allocation T8.

In a third step A3 it is checked whether a disadvantage parameter T2 is set for the destination call T1. If no disadvantage parameter T2 is set, a most favorable call allocation T6 to an elevator cage 1, 1', 1" is determined in a sixth step A6. If a disadvantage parameter T2 is set, at least one disadvantage-free call allocation T8 to a elevator cage 1, 1', 1" is determined in an eighth step A8. Step A3 is carried out only if at least one control parameter T0 is activated by the destination call control 3, 3', 3". If no control parameter T0 is activated no disadvantage-free call allocation T8 is determined for a set disadvantage parameter T2. The control parameter T0 is activated or deactivated by the destination call control 3, 3', 3" in a step A0. The control parameter T0 is deactivated if at least one current level of traffic of the elevator installation exceeds at least one predefined target value or if a current clock time lies in at least one predefined time window or if the desired destination story lies in at least one predefined building zone. Thus, the destination call control 3, 3', 3" can simply and quickly deactivate the control parameter T0 in a case of a high level of traffic or at peak times or for a desired destination story in a specific building zone. In addition, a passenger with a disadvantage authorization can reactivate a deactivated control parameter A0.

At least one elevator profile with at least one parameter T4 specific to elevator installation is set up in a fourth step A4. The elevator profile can be set on one occasion, for example at the time of placing the elevator installation into operation, and stored in a computer readable data memory of the destination call control 3, 3', 3". The elevator profile can be adapted or varied, for example by the building administration. Distinction is made between several parameters T4 specific to elevator installation:

A parameter T4, which is specific to elevator installation, of transport to the desired destination story indicates that a passenger with a disadvantage is transported by an elevator cage 1, 1', 1" to the desired destination story. A passenger without a disadvantage can be transported by a elevator cage 1, 1', 1" to an actual destination story which differs from the desired destination story by at least one story. There is thus avoidance of transport of the passenger with disadvantage to an actual destination story from where he or she in certain circumstances can get to the desired destination story only by way of a staircase or an escalator 9. This has to be avoided particularly for a passenger with a wheelchair.

A parameter T4, which is specification to elevator installation, of transport from the call input story indicates that a passenger with disadvantage is transported by an elevator cage 1, 1', 1" from the call input story. A passenger without a disadvantage can be transported from a start story which differs from the call input story by at least one story. There is thus avoidance of a passenger with a handicap with respect to walking having to take, in certain circumstances, a staircase or an escalator 9 in order to get to the start story, which is to be avoided.

A parameter T4, which is specification to elevator installation, of transport without transfer indicates that a passenger with a disadvantage is transferred by one and the same elevator cage 1, 1', 1". A passenger without a disadvantage can be transported with at least one transfer between elevator cages 1, 1', 1".

A parameter T4, which is specification to elevator installation, of transport without intermediate stop indicates that a passenger with a disadvantage is transferred by the elevator cage 1, 1', 1" without an intermediate stop. A passenger without a disadvantage can be transported by the elevator cage 1, 1', 1" with at least one intermediate stop A parameter T4, which is specification to elevator installation, of transport by a large elevator cage 1, 1', 1" indicates that a passenger with a disadvantage is transported in a large elevator cage 1, 1', 1". A passenger, who is handicapped with respect to walking or sight, with a wheelchair or a guide dog needs more space during transport, so that the elevator cage 1, 1', 1" should be as large as possible.

A parameter T4, which is specification to elevator installation, of transport by a slow elevator cage 1, 1', 1" indicates that a passenger with a handicap-specific aid is transported by a slow elevator cage 1, 1', 1", so that pregnant women or passengers with en intellectual or physical impairment are transported pleasantly.

A parameter T4, which is specification to elevator installation, of transport by a quick elevator cage 1, 1', 1" indicates that a passenger with an aid specific to personal protection is transported by a fastest possible elevator cage 1, 1', 1".

A parameter T4, which is specification to elevator installation, of transport with at least one slowly closing story door indicates that a passenger with a handicap-specific aid is transported by elevator installation with a story door closing as slowly as possible.

A parameter T4, which is specification to elevator installation, of transport with at least one quickly closing story door indicates that a passenger with an aid specific to personal protection is transported by elevator installation with a story door closing as quickly as possible.

The parameter T4 specific to elevator installation is indicated to the passenger as an item of multimedia information, which is a component of the destination call acknowledgement signal. Thus, a size specification of the elevator cage or a destination time of transport by the elevator cage is issued as item of multimedia information to the passenger who inputs a destination call T1 at the call input device 4 or transmits an identification. The item of multimedia information can contain a written text, a graphic, but also a spoken word or a spoken sentence, and a video image. Thus, the destination time can be issued as an elapsing clock time. With knowledge of the present disclosure, the expert can realize further parameters specific to elevator installation.

At least one situation-specific parameter T5 such as an instantaneous elevator cage passenger number during transport of the passenger by the elevator cage 1, 1', 1", an instantaneous travel/passenger number on the route of the passenger to the elevator installation or on the route of the passenger to the travel destination, an instantaneous travel distance of a passenger from the elevator cage 1, 1', 1", etc., is determined in a fifth step A5. Particularly at peak times the rate of arrival of passengers can significantly change at short intervals of time and reach the capacity limit of the elevator installation. In addition, it is desirable to provide an elevator cage 1, 1', 1" on the start story only at the point in time at which the passenger, who is to be moved in the budding in accordance with destination call T1, has actually reached the elevator cage 1, 1', 1". A passenger with disadvantage shall be transported in a elevator cage 1, 1', 1" with smallest transport level. Distinction is made between the following situation-specific parameters T5.

- A situation-specific parameter T5 of elevator cage passenger number indicates the maximum permissible number of passengers in the elevator cage 1, 1', 1" during travel from the start story to the destination story. A passenger, who is handicapped with respect to walking or sight, with a wheelchair or guide dog needs more space in the elevator cage 1, 1', 1", so that the elevator cage passenger number shall be as small as possible. In addition, in the case of a passenger at risk in terms of safety the elevator cage number shall be as small as possible.
- A situation-specific parameter T5 of travel/passenger number is the number of further passengers on the route from the position co-ordinate of the call input device 4 or of the mobile apparatus 5 to the elevator installation and from there to the travel destination. For that purpose the destination call control 3, 3', 3" has use frequencies on the routes of the building. The use frequencies can vary depending on the respective time of day and day of week or holiday. For a passenger with disadvantage the travel/passenger number is as small as possible not only on the call input story, but also on the destination story. For a passenger without disadvantage the travel/passenger number is not optimized with respect to use frequency.
- A situation-specific parameter T5 of travel distance is the distance from the position co-ordinate of the call input device 4 or the mobile apparatus 5 to the elevator installation and from there to a travel destination. The travel destination can be predefined, for example, a specific building door 9 on the destination story. The predefined travel destination is stored in the passenger profile together with the destination call and the disadvantage parameter T2 and, just like this, able to be read out and communicated. The travel destination can, however, also be input on the input apparatus 41 of the input call device 4 or on the input/output apparatus 51, 52 of the mobile apparatus 5 and communicated just like an input destination call T1 or a read-out identification code to the destination call control 3, 3', 3". For a passenger with a disadvantage the travel distance is as short as possible not only on the call input story, but also on the destination story. For a passenger without a disadvantage the situation-specific travel distance is not distance-optimized in that manner.

The situation-specific parameter T5 is issued to the passenger as an item of multimedia information, which is a component of the destination call acknowledgement signal. Thus, a travel/passenger number or a travel distance is issued to the passenger as item of multimedia information. The travel distance can be effected as a permanently updated distance statement, for example, the remaining distance from the current position co-ordinate to the travel destination is issued in meters. With knowledge of the present disclosure the expert can realize further situation-specific parameters.

The most favorable call allocation T6 to an elevator cage 1, 1', 1" is determined in the sixth step A6. The parameter T4 specific to elevator installation and the situation-specific parameter T5 are taken into consideration in the determination of the most favorable call allocation T6 for the destination call T1. The most favorable call allocation T6 denotes that elevator cage 1, 1', 1" which serves the destination call T1 from a start story to a destination story in shortest possible waiting time or in shortest possible destination time.

At least one building profile with at least one building parameter T7 is determined in a seventh step A7. The building profile can be set up on one occasion, for example at the time of placing the elevator installation into operation, and stored in the computer readable data memory of the destination call control 3, 3', 3". The building profile can also be a component of the passenger profile. Distinction is made between several different building parameters T7:

- A building parameter T7 of travel time indicates in which travel time a story door of the elevator installation is reachable from a position co-ordinate of a call input device 4 or of a mobile apparatus 5. A passenger with a disadvantage shall go to the elevator installation in the shortest possible travel time.
- A building parameter T7 of travel path indicates in which travel path a story door of the elevator installation is reachable from a position co-ordinate of a call input device or of a mobile apparatus 5. A passenger with a disadvantage shall cover only a shortest possible travel path to the elevator installation.
- A building parameter T7 of route flatness indicates how flat a route from a position co-ordinate of a call input device 4 or of a mobile apparatus 5 to a story door of the elevator installation is. Since staircases or escalators 9 are only conditionally passable by wheelchairs, they are to be avoided for a passenger with a wheelchair. However, steps or overhangs on the route to the elevator installation also hamper or make impossible the progress of the passenger with a wheelchair and thus similarly represent a disadvantage. A passenger handicapped with respect to walking shall thus take a flattest possible route to the elevator installation.
- A building parameter T7 of route with indicates how wide a route from a position coordinate of a call input device 4 or of a mobile apparatus 5 to a story door of the elevator installation is. A passenger, who is handicapped with respect to walking or sight with a wheelchair or guide dog needs more space in locomotion so that the route to the elevator installation shall be as wide as possible.
- A building parameter T7 of route safety indicates how safe as route from a position co-ordinate of a call input device 4 or of a mobile apparatus 5 to a story door of the elevator installation is. A passenger with an intellectual or psychological impairment or a passenger at risk in terms of safety shall not be subject to uncertainty or worry on the way to the elevator installation. Accordingly, the route to the elevator installation shall be as safe as possible, i.e. the route shall be lit as brightly as possible, surveyable as well as possible, have a medium, not excessive, level of route traffic, etc.

A building parameter T7 of access authorization for an accompanying passenger or a bodyguard indicates whether and under what conditions at least one accompanying passenger or at least one bodyguard can accompany the passenger with disadvantage on the journey from the start story to the destination story. Buildings can have several zones with different access authorizations, which access authorizations are filed passenger-specifically in the passenger profile. It is therefore entirely possible that only the passenger with disadvantage has an access authorization to the story S1 to S8 of the dwelling thereof, but not an accompanying passenger or a bodyguard. If moreover only the passenger with disadvantage, but not the accompanying passenger or the bodyguard, identifies himself or herself for transport from the start story to the destination story the accompanying passenger or the bodyguard can be erroneously interpreted by a security service as an intruder, for example by video monitoring or weight monitoring in the elevator cage 1, 1', 1". The building parameter T7 of access authorization for an accompanying passenger or a bodyguard avoids such an erroneous interpretation. A passenger with disadvantage can thus take a route, which is accompanied by an accompanying passenger or by a bodyguard, to the destination story.

The building parameter T7 is issued to the passenger as an item of multimedia information, which is a component of the destination call acknowledgement signal. Thus, a route description with respect to the elevator installation or the travel destination is issued as an item of multimedia information to the passenger who inputs a destination call T1 or transmits an identification code by the mobile apparatus 5 from a certain distance from the elevator installation. This route description can contain a short text and graphics such as arrows, crosses, etc., as well as spoken route statements such as "left", "right", "straight ahead". In addition, a travel time in the for of an elapsing clock time or a real-time video image for route safety can be issued to the passenger as item of multimedia information. With knowledge of the present disclosure the expert can realize further building parameters.

The disadvantage-free call allocation T8 to a elevator cage 1, 1', 1" is determined in the eighth step A8. The disadvantage-free call allocation T8 denotes that elevator cage 1, 1', 1" which serves the destination call T1 from a start story to a destination story without barriers or risk or without unreasonable routes for the disadvantaged passenger. Barriers can consist of stairs, escalators, ramps or unprotected building areas. The needs of buildings or those caused by traffic, such as, for example, the shaft ends or high traffic utilization of capacity with wasting times can oblige routes which have to be reasonable for the passenger. The parameter T4 specific to elevator installation, the situation-specific parameter T5 and the building parameter T7 are taken into consideration in the determination of the disadvantage-free call allocation 18 for the destination call T1.

Transport from the call input story to the desired destination story, a direct transport, a largest possible elevator cage 1, 1', 1", a slowest possible elevator cage 1, 1', 1", a smallest possible elevator cage passenger number and or a story door closing as slowly as possible is or are taken into consideration as far as possible as parameter T4 specific to elevator installation.

A elevator cage 1, 1', 1" with smallest possible elevator cage passenger number, a smallest possible travel/passenger number with respect to the elevator installation or the travel destination or a shortest possible travel distance from the elevator installation from the travel destination is taken into consideration as situation-specific parameter T5.

A shortest possible travel time, a shortest possible travel path, a flattest possible route, a widest possible route, a safest possible route and/or an accompanied route to the destination story is or are taken into consideration as building parameter T7.

Either an assignment of the most favorable call allocation T6 or an assignment of the disadvantage-free call allocation T8 for transport of the passenger by at least one elevator cage 1, 1', 1" from a start story to a destination story is undertaken in a ninth step A9.

The at least one most favorable call allocation T6 or the at least one disadvantage-free call allocation T8 is issued to the passenger as destination call acknowledgement. More than one most favorable call allocation T6 or more than one disadvantage-free call allocation T8 can also be issued to the passenger as destination call acknowledgement. The several possible most favorable call allocations T6 or the several possible disadvantage-free call allocations T8 are issued together with at least one item of multimedia information on the output apparatus 42 of the call input device 4 or on the input/out apparatus 51, 52 of the mobile apparatus 5. The item of multimedia information indicates to the passenger which most favorable call allocation T6 is optimal with respect to which parameters T4 specific to elevator installation or to which situation-specific parameters T5 or to which building parameters T7. For example, a first most favorable call allocation T6 is optimal with respect to the waiting time, whilst a further most favorable call allocation T6 is optimal with respect to the direction change. For example, a first disadvantage-free call allocation T8 is optimal with respect to the travel path, whilst a further disadvantage-free call allocation T8 is optimal with respect to route safety.

Through confirmation of one of the issued most favorable call allocations T6 or disadvantage-free call allocations 18 by means of the call input device 4 or by means of the mobile apparatus 5 and communication of this confirmation to the destination call control 3, 3', 3" an assignment of these selected most favorable call allocations T6 or disadvantage-free call allocations T8 for transport of the passenger by at least one elevator cage 1, 1', 1" from a start story to a destination story is undertaken. The communication of the confirmation is carried out in the same way, only in reverse direction, as the afore-described communication of the destination call acknowledgement.

The passenger has several possibilities of carrying out confirmation of a most favorable call allocation T6 or of a disadvantage-free call allocation T8. For example, the passenger actuates for that purpose a button of the input apparatus 41 of the call input device 4 or touches a touch screen of the input/output apparatus 51, 52 of the mobile apparatus 5. The computer program means of the call input device 4 is designed in such a manner that on output of a destination call acknowledgement signal on the output apparatus 42 a cursor is movable over several possible most favorable call allocations T6 or over several possible disadvantage-free call allocations T8. The cursor can be movable automatically at a predetermined cycle rate over the call allocations T6, T8, for example, the cursor 1 dwells on each call allocation T6, T8 for a second. As soon as the passenger actuates a button of the input apparatus 41 or touches a touch screen of the input/out apparatus 51, 52 the movement of the cursor is stopped and the call allocation T6, T8 over which the cursor has been stopped is confirmed. However, it is also possible for the passenger to undertake a confirmation without a button or without contact. Thus, the passenger can move the mobile apparatus 5, which is executed as an RFID, into or out of the range of the radio network 7 and in this manner move at least one cursor on the output apparatus 42 of the call input device 4 over call allocations T6, T8. The computer program means of the call input device 4 is then designed in such a manner that on output of a destination call acknowledgement signal on the output apparatus 42, a cursor is movable over several call allocations T6, T8 as long as the RFID is located in the range of the radio network 7 and that the movement of the cursor is stopped as soon as the RFID is no longer located in the range of the radio network 7. With knowledge of the present disclosure an inverse design of the computer program means is obviously also possible, i.e. the cursor is movable over several call allocations T6, T8' as long as the RFID is located outside the range of the radio network 7 and the movement of the cursor is stopped as soon as the RFID is located in the range of the radio network 7.

In the understanding of the present disclosure the conjunction "or" is used in the sense of "and/or".

Having illustrated and described the principles of the disclosed technologies, it will be apparent to those skilled in the art that the disclosed embodiments can be modified in arrangement and detail without departing from such principles. In view of the many possible embodiments to which the principles of the discussed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

The invention claimed is:

1. An elevator destination call control unit configured to generate destination call information for a passenger of an elevator installation, the elevator installation comprising multiple cages and at least one shaft, the destination call information comprising a start story and an actual destination story, the destination call information being based on a desired destination story indicator, an input story indicator and whether a passenger disability indicator is associated with the passenger;

wherein when the passenger disability indicator is associated with the passenger, the elevator destination call control unit determines that the actual destination story is the same as a desired destination story indicated by the desired destination story indicator; and when the passenger disability indicator is not associated with the passenger, the elevator destination call control unit determines that the actual destination story differs from a desired destination story indicated by the desired destination story indicator by at least one story.

2. The elevator destination call control unit of claim 1, wherein when the passenger disability indicator is associated with the passenger the start story is the same as an input story indicated by the input story indicator.

3. The elevator destination call control unit of claim 1, wherein when the passenger disability indicator is not associated with the passenger the start story differs from an input story indicated by the input story indicator.

4. The elevator destination call control unit of claim 1, the destination call information being further based on a building profile.

5. The elevator destination call control unit of claim 1, the destination call information being further based on a situation-specific parameter.

6. An elevator operation method comprising:

receiving a destination call request for an elevator installation for at least one passenger, the elevator installation comprising at least two elevator cages, the destination call request indicating a desired destination floor;

as a result of determining that a disadvantage parameter is associated with the at least one passenger, generating call control signals for at least one of the at least two elevator cages to transport the at least one passenger in one of the at least two elevator cages to the desired destination floor; and as a result of determining that the disadvantage parameter is not associated with the at least one passenger, generating call control signals for at least one of the at least two elevator cages to transport the at least one passenger in one of the at least two elevator cages to a destination floor that is not the desired destination floor.

7. The elevator operation method of claim 6 further comprising when the disadvantage parameter is associated with the at least one passenger, generating call control signals for the at least one of the at least two elevator cages to pick up the at least one passenger at a floor that is the same as an input story indicated by the call request.

8. The elevator operation method of claim 6 further comprising when the disadvantage parameter is not associated with the at least one passenger, generating call control signals for the at least one of the at least two elevator cages to pick up the at least one passenger at a floor that is different from an input story indicated by the call request.

9. The elevator operation method of claim 6, wherein the at least elevator cages form a double elevator cage.

10. The elevator operation method of claim 6, wherein the disadvantage parameter comprises an indication of one or more passenger disabilities.

11. The elevator operation method of claim 6, wherein the disadvantage parameter indicates one or more handicap aids used by the first at least one passenger.

12. The elevator operation method of claim 11, wherein the one or more handicap aids comprise a crutch or a guide stick.

13. An elevator installation system, comprising:

at least two elevator cages;

a control unit, receiving a destination call request for at least one passenger, the destination call request indicating a desired destination floor, wherein:

when said control unit determines that a disadvantage parameter is associated with the at least one passenger, said control unit generates control signals for at least one of said at least two elevator cages to transport the at least one passenger in one of said at least two elevator cages to the desired destination floor; and when said control unit determines that the disadvantage parameter is not associated with the at least one passenger, said call control unit generates call control signals for at least one of said at least two elevator cages to transport the at least one passenger in one of said at least two elevator cages to a destination floor that is not the desired destination floor.

14. The elevator installation system of claim 13, wherein the control unit is further configured such that when the disadvantage parameter is associated with the at least one passenger, the control unit generates call control signals for the at least one of the at least two elevator cages to pick up the at least one passenger at a floor that is the same as an input story indicated by the call request.

15. The elevator installation system of claim 13, wherein the control unit is further configured such that when the disadvantage parameter is not associated with the at least one passenger, the control unit generates call control signals for the at least one of the at least two elevator cages to pick up the at least one passenger at a floor that is different from an input story indicated by the call request.

16. The elevator installation system of claim 13, wherein the at least two elevator cages form a double elevator cage.

17. The elevator installation system of claim 13, wherein the disadvantage parameter comprises an indication of one or more passenger disabilities.

18. The elevator installation system of claim 13, wherein the disadvantage parameter indicates one or more handicap aids used by the first at least one passenger.

19. The elevator installation system of claim 18, wherein the one or more handicap aids comprise a crutch or a guide stick.

* * * * *